US009657912B2

(12) United States Patent
Kanayama et al.

(10) Patent No.: US 9,657,912 B2
(45) **Date of Patent: *May 23, 2017**

(54) LIGHTING APPARATUS AND AUTOMOBILE INCLUDING THE SAME

(71) Applicant: Panasonic Intellectual Property Management Co., Ltd., Osaka (JP)

(72) Inventors: Yoshihiko Kanayama, Hyogo (JP); Makoto Kai, Kyoto (JP); Hiro Aoki, Osaka (JP); Tomoyuki Ogata, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,622

(22) Filed: Sep. 12, 2016

(65) Prior Publication Data

US 2016/0377249 A1 Dec. 29, 2016

Related U.S. Application Data

(63) Continuation of application No. 14/618,148, filed on Feb. 10, 2015, now Pat. No. 9,464,775.

(30) Foreign Application Priority Data

Feb. 24, 2014 (JP) ..... 2014-032686

(51) Int. Cl.
*F21S 8/10* (2006.01)
*F21V 5/08* (2006.01)
*F21Y 115/10* (2016.01)

(52) U.S. Cl.
CPC ..... *F21S 48/1225* (2013.01); *F21S 48/115* (2013.01); *F21S 48/1154* (2013.01);
(Continued)

(58) Field of Classification Search
CPC ..... F21S 48/12; F21S 48/125; F21S 48/1225; F21S 48/1208; F21S 48/1216;
(Continued)

(56) References Cited

U.S. PATENT DOCUMENTS 7,156,544 B2 1/2007 Ishida
9,464,775 B2 * 10/2016 Kanayama ..... F21S 48/1154
(Continued)

FOREIGN PATENT DOCUMENTS

JP 2005-108554 4/2005
KR 20130111739 A 10/2013

OTHER PUBLICATIONS

Co-pending U.S. Appl. No. 14/618,148, filed Feb. 10, 2015.
(Continued)

*Primary Examiner* — Karabi Guharay
(74) *Attorney, Agent, or Firm* — Renner, Otto, Boisselle & Sklar, LLP

(57) ABSTRACT

A lighting apparatus includes: a base that is open toward a front and includes a low beam light-distribution pattern forming component; a lens body disposed forward of the base; a first light-emitting device; and a second light-emitting device. Incident light is refracted in a lower portion of the lens body, and the incident light and exiting light travel in substantially same direction in an upper portion of the lens body. The first light-emitting device is disposed behind the lower portion of the lens body, the second light-emitting device is disposed further forward than the first light-emitting device and behind the upper portion of the lens body, and the low beam light-distribution pattern forming component is disposed in front of the first light-emitting device.

4 Claims, 5 Drawing Sheets

(52) U.S. Cl.
CPC ..... *F21S 48/1159* (2013.01); *F21S 48/125* (2013.01); *F21S 48/1258* (2013.01); *F21S 48/1329* (2013.01); *F21S 48/1388* (2013.01); *F21S 48/31* (2013.01); *F21S 48/33* (2013.01); *F21Y 2115/10* (2016.08)

(58) Field of Classification Search
CPC ..... F21S 48/1155; F21S 48/1159; F21S 48/1329; F21S 48/1388; B60Q 1/04; B60Q 1/0041
See application file for complete search history.

(56) References Cited

U.S. PATENT DOCUMENTS

| | | | |
|---|---|---|---|
| 2005/0068787 | A1 | 3/2005 | Ishida |
| 2008/0112180 | A1 | 5/2008 | Okada |
| 2008/0253142 | A1 | 10/2008 | Nakada |
| 2011/0026266 | A1 | 2/2011 | Sasaki |
| 2011/0249460 | A1 | 10/2011 | Kushimoto |
| 2012/0262935 | A1 | 10/2012 | Yamamoto |
| 2013/0051053 | A1 | 2/2013 | Yasuda |
| 2013/0335990 | A1 | 12/2013 | Sato |

OTHER PUBLICATIONS

Chinese Office Action and Search Report (with English translation) dated Sep. 26, 2016 for corresponding Chinese Application No. 201510067438.6.

* cited by examiner

LIGHTING APPARATUS AND AUTOMOBILE INCLUDING THE SAME

CROSS REFERENCE TO RELATED APPLICATION

This application is a continuation of U.S. patent application Ser. No. 14/618,148 filed on Feb. 10, 2015 and claims the benefit of priority of Japanese Patent Application Number 2014-032686, filed Feb. 24, 2014, the entire content of which is hereby incorporated by reference.

TECHNICAL FIELD

The present disclosure relates to a lighting apparatus and an automobile including the lighting apparatus.

BACKGROUND ART

Lighting apparatuses such as headlights are disposed in the front portion of an automobile. This type of lighting apparatus includes: a base that is open toward the front; a lens body disposed forward of the base; a first light-emitting device for low beam-use disposed behind the lens body, above the base; and a second light-emitting device for high beam-use disposed behind the lens body, below the base (for example, see Japanese Unexamined Patent Application Publication No. 2005-108554).

Furthermore, a low beam light-distribution pattern forming component for forming a low beam light-distribution pattern is disposed in the base, in front of the first light-emitting device and the second light-emitting device.

SUMMARY

In the above-described lighting apparatus, the low beam light-distribution pattern forming component blocks the light from the first light-emitting device for low beam-use that is directed toward oncoming vehicles, and, instead, guides the light toward the sidewalk. In other words, oncoming vehicles are not dazzled, and checking of the sidewalk is facilitated.

On the other hand, when oncoming vehicles are not present, the driver turns ON the second light-emitting device for high beam-use in order to improve forward visibility.

However, since the low beam light-distribution pattern forming component is disposed in the base, in front of the first light-emitting device and the second light-emitting device in the conventional lighting apparatus, the low beam light-distribution pattern forming component causes a dark streak in the light emitted from the second light-emitting device. As such, even when the second light-emitting device for high beam-use is used to emit light when oncoming vehicles are not present, forward visibility cannot be sufficiently improved.

An object of the present disclosure is to provide a lighting apparatus and an automobile that are capable of improving visibility during high beam light-distribution pattern illumination even when equipped with a low beam light-distribution pattern forming component.

In order to achieve the aforementioned object, a lighting apparatus according to an aspect of the present invention includes: a base that is open toward a front and includes a low beam light-distribution pattern forming component; a lens body disposed forward of the base; a first light-emitting device; and a second light-emitting device, wherein incident light is refracted in a lower portion of the lens body, the incident light and exiting light travel in substantially same direction in an upper portion of the lens body, the first light-emitting device is disposed behind the lower portion of the lens body, the second light-emitting device is disposed further forward than the first light-emitting device and behind the upper portion of the lens body, and the low beam light-distribution pattern forming component is disposed in front of the first light-emitting device.

Accordingly, visibility during high beam light-distribution pattern illumination can be improved.

BRIEF DESCRIPTION OF THE DRAWINGS

The figures depict one or more implementations in accordance with the present teaching, by way of examples only, not by way of limitations. In the figures, like reference numerals refer to the same or similar elements.

DETAILED DESCRIPTION

Hereinafter, exemplary embodiments of the present invention will be described with reference to the drawings. It should be noted that each of the subsequently-described embodiments show a specific preferred example of the present invention. Therefore, shapes, materials, structural components, the arrangement and connection of the structural components, etc. shown in the following exemplary embodiment are mere examples, and are not intended to limit the scope of the present invention.

Hereinafter, in this disclosure, "front/forward" refers to the direction in which light is emitted from the lighting apparatus (i.e., the light-emitting direction) and the light-extraction direction in which light is extracted, and "back/behind" refers to the direction opposite the "front/forward" direction. Furthermore, "front/forward" refers to the direction of travel when an automobile moves forward.

It should be noted that the respective figures are schematic diagrams and are not necessarily precise illustrations. Furthermore, in the respective figures, substantially identical components are assigned the same reference signs, and overlapping description is omitted or simplified.

Embodiment

Figure 1:
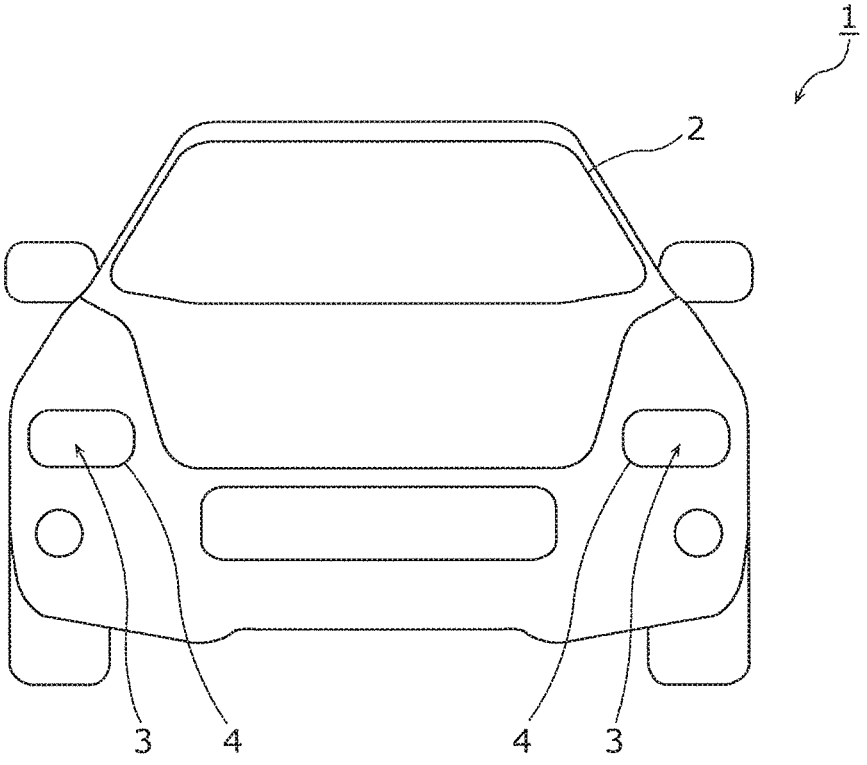
FIG. 1 is a front view of an automobile according to an exemplary embodiment.

An automobile 1 according to an exemplary embodiment will be described using FIG. 1. FIG. 1 is a front view of an automobile according to this embodiment.

As illustrated in FIG. 1, the automobile 1 is an example of a vehicle such as a four-wheeled automobile, and includes a vehicle body 2, and a pair of lighting units 3 disposed at the upper portion of the left and right sides of the front of the vehicle body 2. A front face cover 4 is provided to each of the lighting units 3 in order to prevent the entry of rain water and dust. A lighting apparatus 5 illustrated in FIG. 2 to FIG.

6 is disposed behind each of the front face covers 4. The lighting apparatus 5 is, for example, a headlight. In this manner, the automobile 1 includes the light apparatuses 5, and the vehicle body 2 having a front portion in which the lighting apparatuses 5 are disposed.

Figure 2:
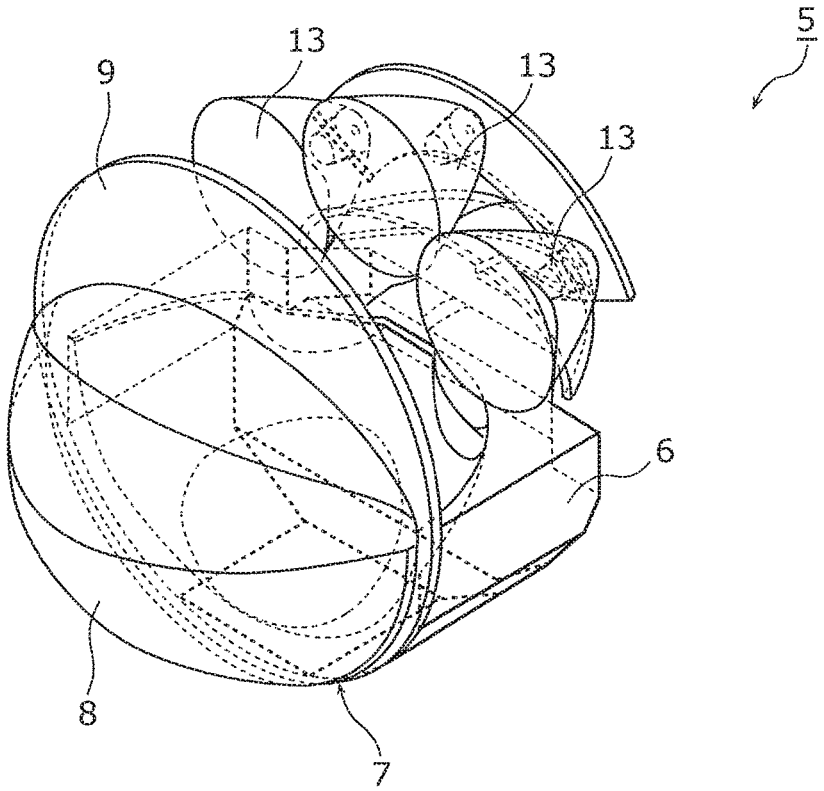
FIG. 2 is a perspective view of a lighting apparatus according to the exemplary embodiment.
Figure 3:
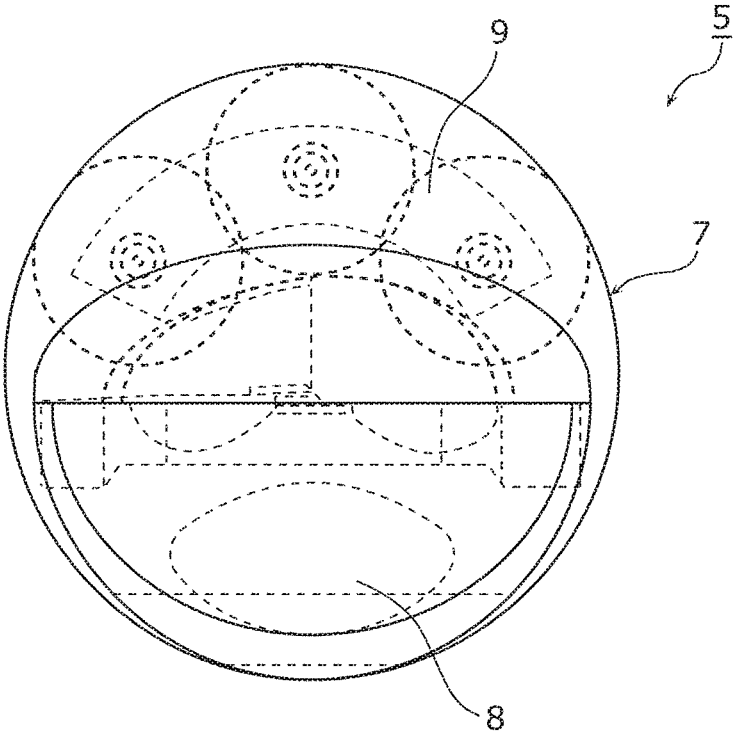
FIG. 3 is a front view of the lighting apparatus according to the exemplary embodiment.
Figure 4:
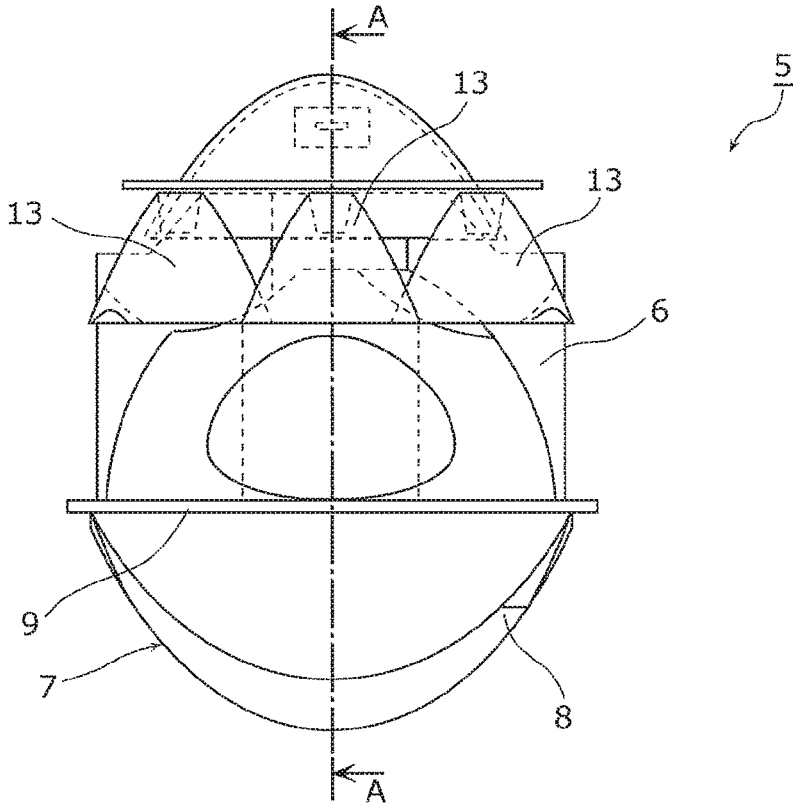
FIG. 4 is plan view of the lighting apparatus according to the exemplary embodiment.
Figure 5:
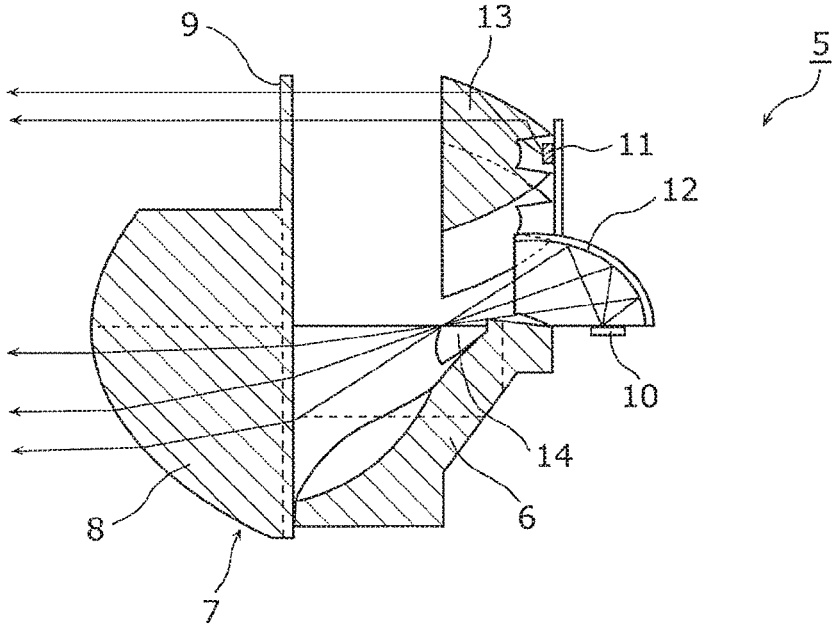
FIG. 5 is a cross-sectional view of the lighting apparatus according to the exemplary embodiment at line A-A in FIG. 4.
Figure 6:
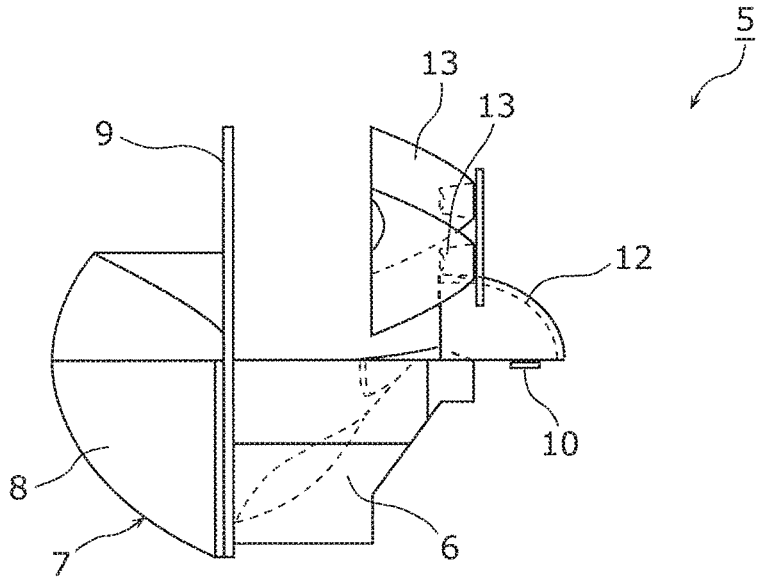
FIG. 6 is side view of the lighting apparatus according to the exemplary embodiment.

FIG. 2 is a perspective view of a lighting apparatus according to this embodiment; FIG. 3 is a front view of the lighting apparatus; FIG. 4 is a plan view of the lighting apparatus; FIG. 5 is a cross-sectional view of the lighting apparatus at line A-A in FIG. 4; and FIG. 6 is side view of the lighting apparatus.

As illustrated in FIG. 2 to FIG. 6, the lighting apparatus 5 is configured to emit light forward, and includes a base 6 that is open toward the front and top, a lens body 7 disposed forward of the opening of the front face-side of the base 6, a first light-emitting device 10, and second light-emitting devices 11. The lighting apparatus 5 according to this embodiment further includes a first reflector 12 and second reflectors 13.

A refractive portion (light-refractive portion) 8 is provided in a lower portion of the lens body 7, and a non-refractive portion (non light-refractive portion) 9 is provided in an upper portion of the lens body 7. The refractive portion 8 has a function of refracting passing light, and has, for example, a substantially hemispherical shape that projects forward. The non-refractive portion 9 has a function of allowing passing light to pass without being refracted, and is, for example, plate-like.

The lens body 7 is, for example, integrally molded from a transparent synthetic resin. It should be noted that it is sufficient that the non-refractive portion 9 be of a material that allows passing light to exit in substantially the same direction as the incident light.

As illustrated in FIG. 5, the first light-emitting device 10 is disposed behind the refractive portion 8 of the lens body 7. The first light-emitting device 10 is a light-emitting device for low beam-use and is, for example, a light-emitting diode (LED).

As illustrated in FIG. 5, the second light-emitting devices 11 are disposed further forward than the first light-emitting device 10 and behind the non-refractive portion 9. The second light-emitting devices 11 are also, for example, LEDs.

As one example, the first light-emitting device 10 and the second light-emitting devices 11 are white LEDs that emit white light, and may be of the surface mount device (SMD) structure or the chip on board (COB) structure.

The first reflector 12 is disposed above the first light-emitting device 10. Furthermore, the second reflectors 13 are disposed in front of the second light-emitting devices 11. In this embodiment, plural (for example, three) second reflectors 13 and plural second light-emitting devices 11 are provided, and the second reflectors 13 and the second light-emitting devices 11 are arranged in a one-to-one correspondence.

The first reflector 12 has a substantially hemispherical surface shape that is open toward the front and bottom. The inner face of the first reflector 12 is a curved face, and is a reflective face (mirror face). Furthermore, the first light-emitting device 10 is disposed below the first reflector 12.

Therefore, as indicated by the arrows in FIG. 5, light emitted upward from the first light-emitting device 10 is reflected off the curved face on the bottom face-side of the first reflector 12 and travels toward the refractive portion 8 of the lens body 7. The reflected light is refracted by and passes through the refractive portion 8 of the lens body 7, and is thus subsequently emitted in the form of the low beam light-distribution pattern. In other words, the low beam light-distribution pattern is formed by way of the light of the first light-emitting device 10 being controlled by the first reflector 12 and the refractive portion 8 of the lens body 7.

In order to form this low beam light-distribution pattern, a low beam light-distribution pattern is provided at the upper portion of the base 6, in a portion that is further forward than the front opening of the first reflector 12. Specifically, the low beam light-distribution pattern (a pattern in which the illumination area is blocked on the oncoming vehicle-side and widened in the sidewalk-side) is formed by a low beam light-distribution pattern forming component 14. The light-distribution pattern forming component 14 is disposed in front of the first light-emitting device 10. It should be noted that the light-distribution pattern forming component 14 is a part of the base 6 and is provided integrally with the base 6.

On the other hand, each of the second reflectors 13 have a substantially conical shape with a diameter increasing toward the front. The second reflector 13 is, for example, a lens body, and is, as one example, a collimating lens. Furthermore, the second light-emitting devices 11 are disposed in the small diameter-side (back-side) of the second reflectors 13.

Therefore, as indicated by the arrows in FIG. 5, the light emitted forward from each of the second light-emitting devices 11 is totally reflected off the inner face of the truncated conical and curved outer wall of the corresponding second reflector 13 and travels forward as collimated light. The collimated light passes through the non-refractive portion 9 of the lens body 7 and is subsequently emitted in the form of the high beam light-distribution pattern. In other words, the high beam light-distribution pattern is formed by way of the light from the second light-emitting devices 11 being controlled by the second reflectors 13 and the non-refractive portion 9 of the lens body 13.

In this embodiment, since the second light-emitting devices 11 for high beam-use are disposed above and further forward than the first light-emitting device 10 for low beam-use, at this time, the light from the second light-emitting devices 11 that is directed toward the non-refractive portion 9 of the lens body is not affected by the light-distribution pattern forming component 14. In other words, compared to the low beam light-distribution pattern, the high beam light-distribution pattern is emitted further forward and, in addition, is capable of sufficiently illuminating the oncoming vehicle-side. As a result, visibility during high beam light distribution pattern illumination can be improved.

It should be noted that it is sufficient that the second reflectors 13 are of a shape allows for total reflection in the main outer wall (lateral face). Accordingly, the substantially conical shape includes a conical shape having a cut-off apex (i.e., a truncated cone shape) or an elliptical cone. Furthermore, as illustrated in FIG. 4, a portion of the lateral face of each of the second reflectors 13 may be cut out. Adjacent second reflectors 13 may be brought together at these cutout portions to reduce the size of the lighting apparatus. Furthermore, the second reflectors 13 may be integrally molded as a connected body. This reduces the number of components and thus facilitates fabrication.

Furthermore, in this embodiment, in order to emit the high beam light-distribution pattern farther and brighter, a plurality of the second light-emitting devices 11 are arranged laterally and the second reflectors are disposed in front of the respective second light-emitting devices 11. In addition, as illustrated in FIG. 3, the front face-side of the second reflectors 13 are located inward of the peripheral portion of the non-refractive portion 9 of the lens body 7. In other words, when viewed from the front, the second reflectors 13 are hidden by the non-refractive portion 9 of the lens body 7.

Furthermore, in this embodiment, a reflective face is formed, by plating, in the low beam light-distribution pattern forming component 14-portion of the base 6 and the portion of the base 6 in front of the low beam light-distribution pattern forming component 14 (i.e., the portion on the lens body 7-side). In contrast, although the second reflectors 13 are integrally formed from a transparent resin, a total reflection-type reflective face is formed in the inner face-side of the second reflectors 13 by mirror-finishing the outer peripheral surface of the second reflectors 13.

As described above, in the lighting apparatus 5 according to this embodiment, the non-refractive portion 9 is provided in the upper portion of the lens body 7, and the second light-emitting devices 11 are provided behind the non-refractive portion 9. With this, the high beam light-distribution pattern is not affected by the low beam light-distribution pattern forming component 14. Therefore, visibility during high beam light-distribution pattern illumination can be improved even in the lighting apparatus 5 that includes the low beam light-distribution pattern forming component 14.

Modifications

Although the lighting apparatus, automobile, etc. according to the present invention are described based on an exemplary embodiment, the present invention is not limited to this exemplary embodiment.

For example, although a headlamp that emits a low beam light-distribution pattern and a high beam light-distribution pattern is described in the forgoing embodiment, the present invention can also be applied to, for example, a fog lamp light-distribution pattern, a daylight running lamp/daytime running light (DLR) light-distribution pattern, and an indicator lamp light-distribution pattern.

Furthermore, although the automobile is exemplified by a four-wheeled automobile in the foregoing embodiments, other automobiles such as a two-wheeled automobile (motorbike) are also acceptable.

Furthermore, although the LED is given as an example of a light-emitting device, other solid-state light-emitting devices such as organic electroluminescence (EL) solid-state light-emitting devices or existing lamps such as high intensity discharge (HID) lamps may be used.

Forms obtained by various modifications to the exemplary embodiments and modifications that can be conceived by a person of skill in the art as well as forms realized by arbitrarily combining structural components and functions in the exemplary embodiments and modifications which are within the scope of the essence of the present invention are included in the present invention.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting apparatus comprising:

a base that is open toward a front and includes a low beam light-distribution pattern forming component;

a lens body disposed forward of the base;

a first light-emitting device; and a second light-emitting device, wherein incident light is refracted in a lower portion of the lens body, the incident light and exiting light travel in substantially same direction in an upper portion of the lens body, the first light-emitting device is disposed behind the lower portion of the lens body, the second light-emitting device is disposed further forward than the first light-emitting device and behind the upper portion of the lens body, and the low beam light-distribution pattern forming component is disposed in front of the first light-emitting device.

2. The lighting apparatus according to claim 1, further comprising:

a first reflector disposed above the first light-emitting device; and a second reflector disposed in front of the second light-emitting device.

3. The lighting apparatus according to claim 2, wherein the first reflector has a substantially hemispherical shape that is open toward the front, and the second reflector has a substantially conical shape with a diameter increasing toward the front.

4. An automobile comprising:

the lighting apparatus according to claim 1; and a vehicle body having a front portion in which the lighting apparatus is disposed.

* * * * *